United States Patent [19]

Parrott

[11] Patent Number: 4,515,409

[45] Date of Patent: May 7, 1985

[54] MINING MACHINE

[75] Inventor: George A. Parrott, Wakefield, England

[73] Assignee: Dresser Europe S.A., Brussels, Belgium

[21] Appl. No.: 284,516

[22] Filed: Jul. 17, 1981

[30] Foreign Application Priority Data

Jul. 18, 1980 [GB] United Kingdom ..... 802356

[51] Int. Cl.[3] ..... E21C 29/22

[52] U.S. Cl. ..... 299/43; 105/29 R

[58] Field of Search ..... 299/42, 43; 105/29 R

[56] References Cited

U.S. PATENT DOCUMENTS

| | | | |
|---|---|---|---|
| 339,831 | 4/1886 | Abt | 105/29 R |
| 1,523,363 | 1/1925 | Howell | 105/29 R |
| 1,523,364 | 1/1925 | Batchelder | 105/29 R |
| 4,067,620 | 4/1978 | Lanfermann | 299/43 |
| 4,082,361 | 1/1978 | Lanfermann | 299/43 |
| 4,097,091 | 6/1978 | Knorr | 299/43 |
| 4,099,787 | 7/1978 | Askew | 299/43 |
| 4,166,652 | 9/1979 | Oberste-Beulmann | 299/43 |
| 4,183,585 | 1/1980 | Brennan | 299/43 |

FOREIGN PATENT DOCUMENTS

| | | |
|---|---|---|
| 235681 | 6/1925 | United Kingdom . |
| 1569912 | 12/1976 | United Kingdom . |
| 1528398 | 10/1978 | United Kingdom . |
| 2015450 | 9/1979 | United Kingdom . |
| 2054702 | 2/1981 | United Kingdom . |
| 2063967 | 6/1981 | United Kingdom . |

*Primary Examiner*—William F. Pate, III

*Attorney, Agent, or Firm*—Larson and Taylor

[57] ABSTRACT

A haulage system for a mining machine comprises a mining machine mounted on and/or guided by a conveyor and reciprocable with respect thereto, the conveyor being provided with a rack having plural rows of teeth of identical pitch, with the teeth of one row staggered with respect to an adjacent row(s), and the machine being provided with at least one power driven haulage sprocket comprising plural sets of peripherally arranged teeth of identical pitch, one set being angularly staggered with respect to an adjacent set(s), whereby one set is engageable with each row of teeth of the rack. The invention also includes a mining machine provided with such a power driven haulage sprocket, and a rack as above described and provided with end fittings for securing in articulated manner to an adjacent rack.

11 Claims, 7 Drawing Figures

MINING MACHINE

This invention relates to a haulage system for a mining machine of the kind adapted to be reciprocated along a mineral face and mounted on and/or guided by an armoured, scraper chain conveyor extending along the face and comprising a plurality of pans secured together end-to-end; to a mining machine adapted for use with such a haulage system; and to a rack for such haulage system.

In contrast to a widely used haulage technique whereby a tensioned, round link chain of e.g. 200 yds. length, is staked at each end of the mineral face, and threaded around a powered drive sprocket carried by the machine, several so-called "chainless" haulage systems have been proposed in recent years principally with a view to eliminating the staked haulage chain and its attendant disadvantages whilst simultaneously providing for the possibility of multimachine operation on the same mineral face. Such chainless systems operate on the rack and pinion principle, the rack being in the form of toothed or pocketed elements attached to the individual pans of the conveyor, and the pinion being either in the form of a toothed sprocket or alternatively in the form of a relatively short, endless chain which may be employed to give multipoint engagement with the rack. In order to obtain a satisfactory haulage output from most chainless systems, it has usually been necessary firstly to replace the usual slide shoes of the machine underframe with rollers and secondly, in systems employing a haulage pinion, to duplicate the drive and employ two pinions to give reduced tooth loading and also to give an arrangement whereby when one pinion passes over a joint between adjacent racks, where optimum haulage conditions may not be possible, the other pinion is clear of any such joint.

According to a first aspect of the present invention, a haulage system for a mining machine comprises at least one mining machine mounted on and/or guided by an armoured, scraper chain conveyor and reciprocable with respect thereto, the conveyor extending along a mineral face and comprising a plurality of individual pans secured together end-to-end, each pan having a face side sidewall and a goaf side sidewall interconnected by a deck plate, one sidewall being provided with a rack having plural rows of teeth of identical pitch, with one row laterally spaced with respect to an adjacent row(s), and also with the teeth of one row staggered with respect to an adjacent row(s) and the machine being provided with at least one power driven haulage sprocket comprising plural sets of peripherally arranged teeth of identical pitch, the sets being laterally spaced from one another and one set being angularly staggered with respect to an adjacent set(s), whereby one set is engageable with each row of teeth of the rack.

A rack may be provided on the face side sidewall or the goaf side sidewall to suit particular operating conditions.

According to a second aspect of the present invention, a mining machine, adapted to be mounted on and/or guided by an armoured, scraper chain conveyor extending along a mineral face and reciprocated with respect thereto, comprises at least one power driven haulage sprocket having plural sets of peripherally arranged teeth of identical pitch, the sets being laterally spaced from one another and one set being angularly staggered with respect to an adjacent set(s).

The machine may be of the conveyor mounted, or "in-web" shearer type, while the or each haulage sprocket may be rotatable about a horizontal or a vertical axis. Preferably, the or each haulage sprocket incorporates two sets of teeth. Thus, the or each haulage sprocket may be formed from two individual and identical pinions secured coaxially together. The tooth stagger at the or each haulage sprocket is preferably a fraction of the tooth pitch e.g. dependent upon the number of pinions employed. It is further preferred for the or each haulage sprocket to be located adjacent a trapping shoe mounted on, and carried by, the mining machine, the trapping shoe incorporating a tongue or projection. The machine may be provided with two haulage sprockets located towards each end of the machine, and both on the face side or both on the goaf side of the machine.

According to a third aspect of the present invention, a rack for a mining machine haulage system comprises plural rows of teeth of identical pitch, with one row laterally spaced with respect to an adjacent row, and also with the teeth of one row being staggered with respect to an adjacent row, the rack being provided at each end thereof with an end fitting whereby it may be secured in articulated manner to adjacent and similar rack(s).

Preferably, each rack incorporates two rows of teeth, while the tooth stagger is at a fraction of the tooth pitch. Conveniently, the rack also provides a continuous surface extending in the direction of the rows of teeth whereby, in use, a tongue or projection of a trapping shoe mounted on, and carried by, a mining machine, may engage the continuous surface. Preferably, one row of teeth terminates in a convex surface, while the other row of teeth terminates at one end in a convex surface and at the other end in a complementary concave surface.

The racks may be provided with teeth by flame cutting from plate. In detail, a two-row rack may comprise an inner, toothed plate carrying one row of teeth spaced from an outer, toothed plate carrying the other row of teeth by a spacer beam, both plates being welded or bolted to the spacer beam. Conveniently, the inner toothed plate has a lower edge projecting below that of the outer toothed plate to enter a recess in a trapping shoe of a mining machine. Conveniently, the ends of the outer row of teeth stop short of the ends of the inner row of teeth, to provide space for various elements of an upper joint between adjacent racks, with the space between adjacent ends being filled by a removable bridging tooth. Thus, if the outer rows terminate in convex ends, the bridging tooth is provided with complementary concave recesses. The bridging tooth is connected by elongated holes to the inner and outer plates in such a way as to provide space compensation when articulated in the vertical and horizontal planes.

Preferably, lower joints are also provided between adjacent racks, the lower joints being of a type that avoids the use of bolts and incorporates an inverted "U" shaped connector, the downwardly directed ends of which engage behind abutment blocks.

The rack may be secured e.g. by welding or bolts, to a support plate attached e.g. by holts, to one sidewall of a conveyor pan.

The invention will now be described in greater detail, by way of example, with reference to the accompanying drawings, in which.

In all embodiments, like components have been accorded like reference numerals.

Figure 1:
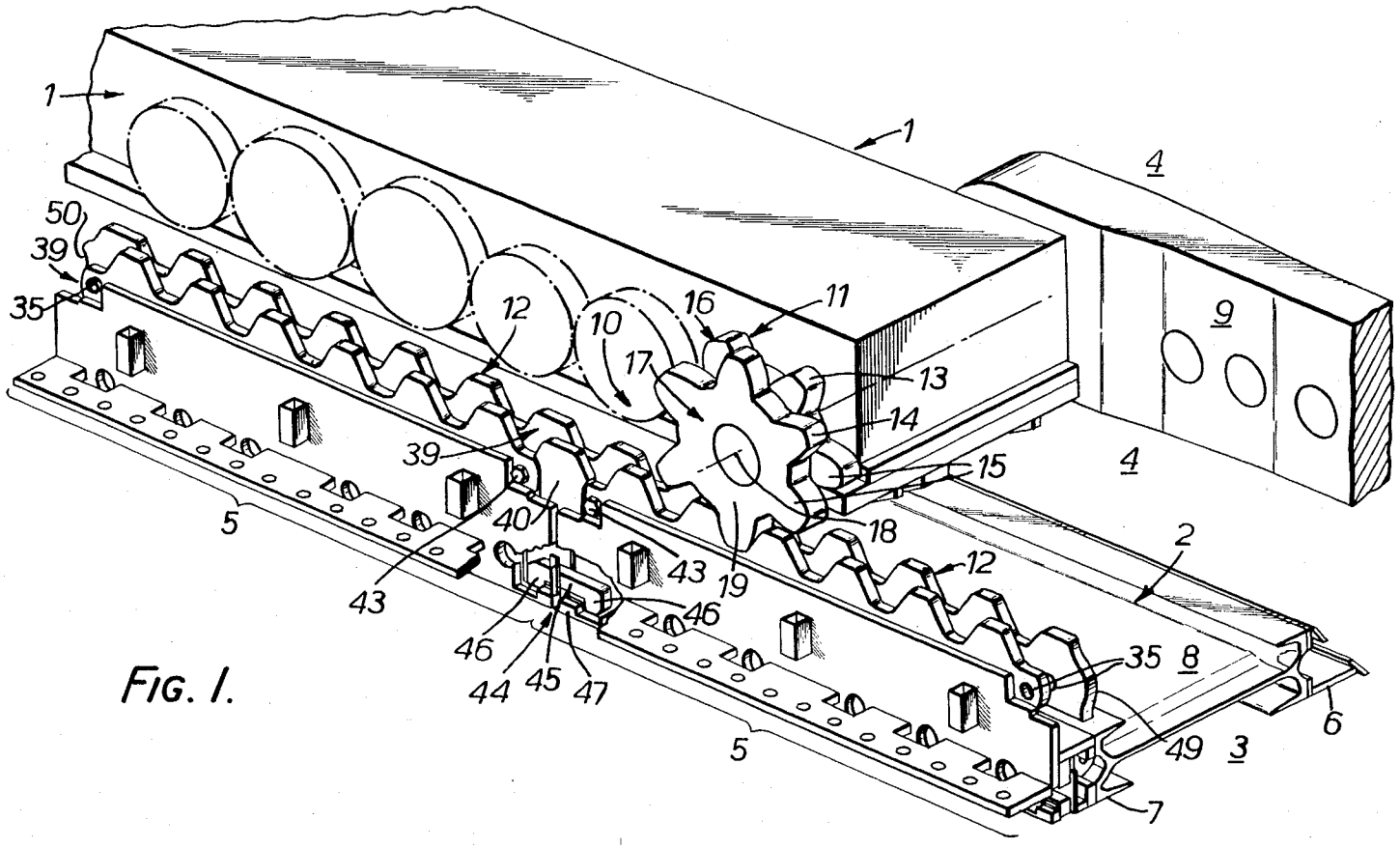
FIG. 1 is a perspective view, looking from the face side of a first embodiment of haulage system, mining machine and rack in accordance with the present invention.

In the drawings, a shearer type mining machine 1 is mounted on, and guided by an armoured, scraper chain conveyor 2 (the conventional chain(s) and flight bars not being illustrated) seated on a mine floor 3, extending along a mineral face 4, and made up of a plurality of line pans 5 secured together end-to-end, each pan 5 having a face side sidewall 6 and a goaf side sidewall 7 of conventional sigma section, the sidewalls 6 and 7 being interconnected by a deck plate 8. Webs of mineral are extracted from the face 4 by a pick-carrying, rotary cutting head (not shown) mounted in the conventional manner at one end of a ranging arm 9 pivotally attached to the machine 1 and pivotable with respect to the machine 1 in the conventional manner under the control of a double-acting hydraulic ram (not shown). The webs of mineral are removed from the face 4 by reciprocating the machine 1 along the conveyor 2 and as is well known in the art. The machine 1 may be single ended (having a ranging arm 9 and cutting head at one end only of the machine) whereby after a cutting run has been effected along the face 4, the machine is reciprocated to the other end of the face in a non-cutting run, ready for commencement of the next cutting run; or alternatively the machine 1 may be double-ended (having a ranging arm 9 and a cutting head at both ends of the machine) whereby bi-directional cutting is effected. The or each cutting head is rotatable, through a speed reduction gearing, from an electric motor housed within the machine.

Whether the machine is single or double-ended, haulage of the machine along, or with respect to the conveyor, is required, and in accordance with the present invention this is effected by a haulage system 10 comprising basically a driven haulage sprocket 11 in engagement with a rack 12.

The sprocket 11 is powered from either the same electric motor within the machine employed for driving the or each cutting head or from a separate electric motor, the power being conveyed from the motor by a mechanical or hydraulic transmission, in the well known manner.

The sprocket 11 comprises two sets 13 and 14 of peripherally arranged teeth 15 of identical pitch arranged on individual pinions 16 and 17, the sets 13 and 14 abutting one another and hence being laterally spaced from one another and the teeth 15 of one set 13 being angularly staggered with respect to the adjacent set 14.

Figure 2:
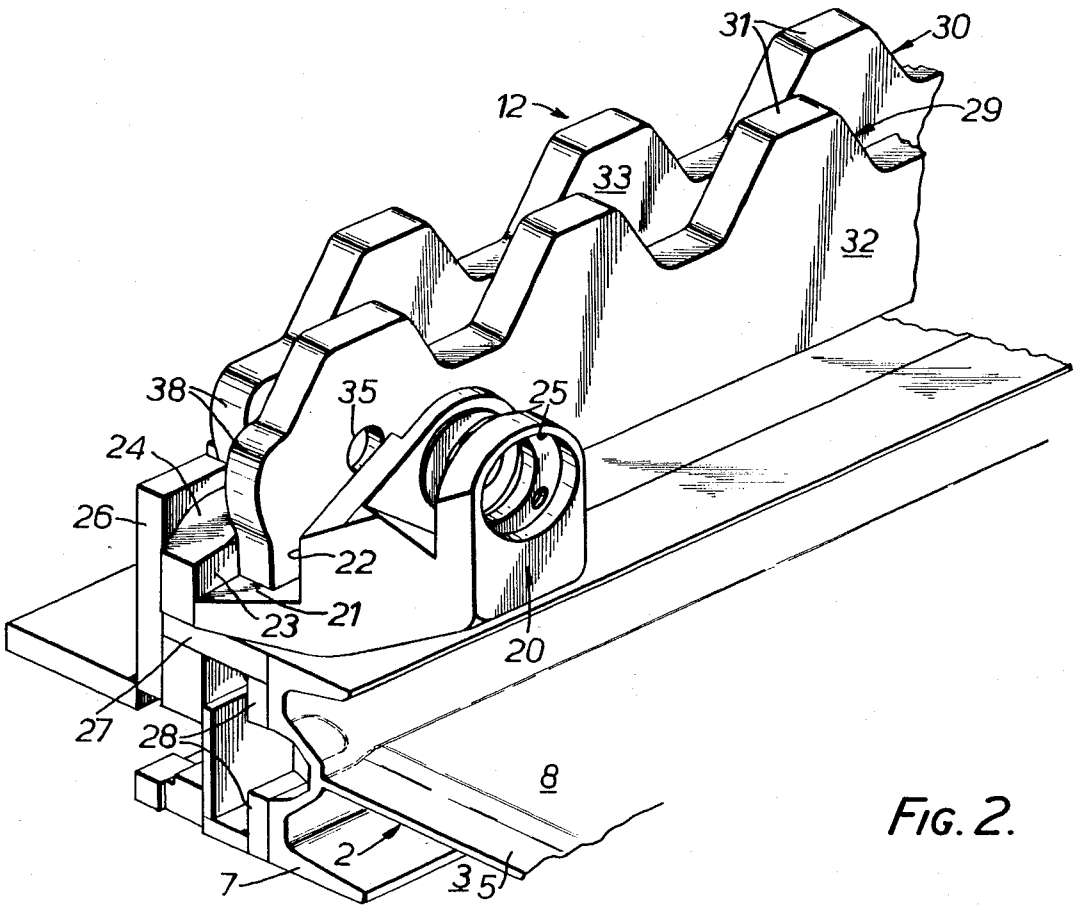
FIG. 2 is a perspective view of a portion of FIG. 1.
Figure 3:
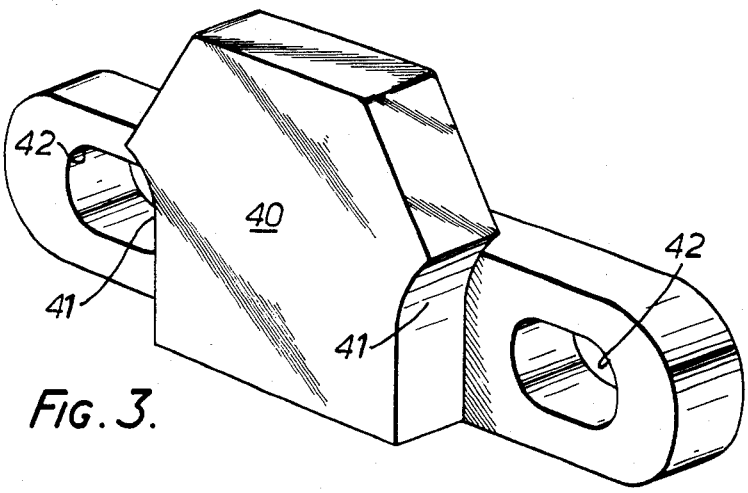
FIG. 3 is a perspective view of a bridging tooth of FIG. 1.
Figure 4:
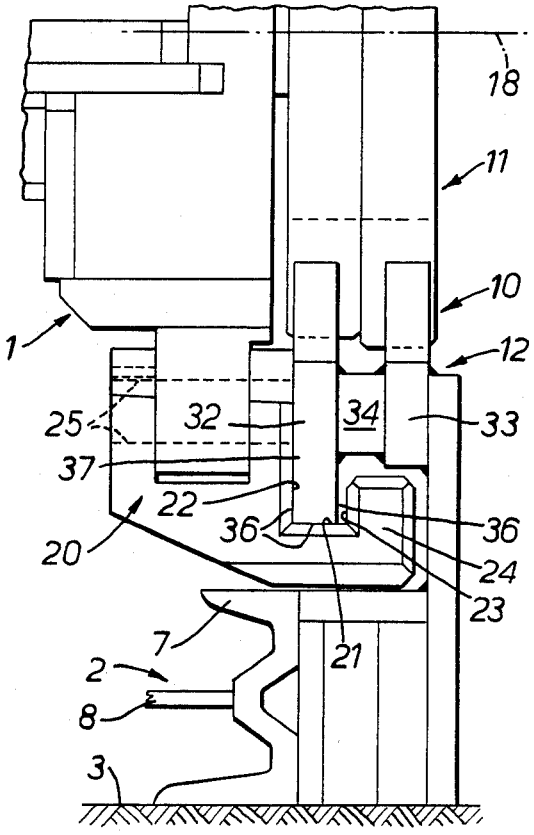
FIG. 4 is an end elevation of a portion of FIG. 1.

In the embodiment of FIGS. 1 to 3, only one sprocket 11 is provided, rotatable about a horizontal axis 18, assuming the conveyor 2 is located in a horizontal plane, on a drive shaft 19. The machine 1 is supported from the conveyor by slide shoes, and as illustrated in FIG. 2, a shoe 20 adapted to slide along the goaf side sidewall 7 is a trapping shoe serving to trap the machine to the conveyor by being provided with a "U"-shaped recess 21 defined between faces 22 and 23, and also provided with a tongue 24. The shoe 20 is also provided with circular apertures 25 for the passage therethrough of a mounting shaft by which the shoe 20 is pivotally attached to the machine 1.

Also in the embodiment of FIGS. 1 to 4, the rack 12 is attached to the goaf side sidewall 7 via plates 26, 27 and 28. In detail, the rack 12 has two rows 29, 30, of teeth 31, with one row 29 provided on an inner toothed plate 32 and the other row 30 provided on an outer toothed plate 33, with the plates 32 and 33 separated by an interposed spacer beam 34 and with teeth 31 of one row 29 staggered with respect to teeth 31 of the adjacent row 30, whereby one set 13 of sprocket teeth 15 is engageable with one row 29 of rack teeth 31, while the other set 14 of sprocket teeth 15 is engageable with the other row 30 of rack teeth 31. The rack 12 also provides continuous surfaces 36 on a lower edge 37 of the inner plate 32 to enter the recess 21 of the trapping shoe.

As can be seen in FIGS. 1 and 2, each row 30, of teeth 31 terminates in a convex surface 38, while each row 29 terminates at one end in a convex surface 49 and at the other end in a complementary concave recess 50 (FIG. 1) to receive, in abutting manner a convex surface 49 of an adjacent row 32. At each end of each pan 5 the ends of the outer row 30 of teeth stop short of the ends of the inner row of teeth to provide space for an upper joint 39 between adjacent racks 12. The joint 39 includes a bridging tooth 40 which fills the space, the bridging tooth 40 being detailed in FIG. 3 and having concave recesses 41 to receive, convex surfaces 38 and elongated holes 42 for the passage of securing bolts 43 through the elongated holes and through coaxial holes 35 in the inner and outer plates 32, 33. A lower joint 44 between adjacent rack bars 12 includes an inverted "U"-shaped connector 45, the downwardly directed ends 46 of which engage behind abutment blocks 47.

Figure 5:
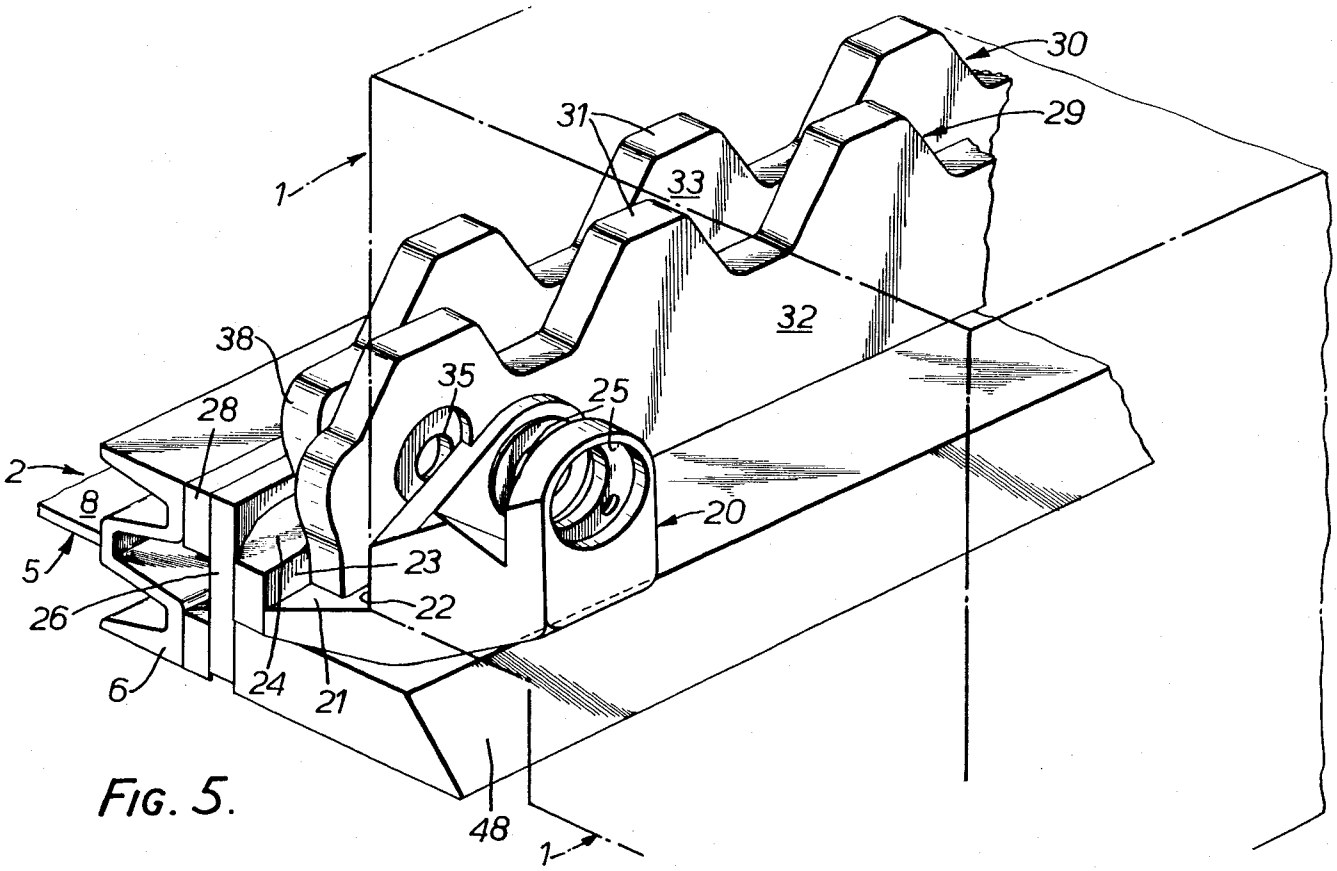
FIG. 5 is a perspective view, corresponding to FIG. 2, of a second embodiment of haulage system and rack in accordance with the present invention.

The embodiment of FIG. 5 is very similar to that of FIGS. 1 to 3, but shows the rack 12 attached to the face side sidewall 6, and a ramp plate 48 to assist loading of mineral onto the conveyor 2, with the machine 1 illustrated not being mounted on the conveyor 2, but seating on the mine floor beyond the ramp plate 48, being an "in-web" or buttock machine.

Figure 6:
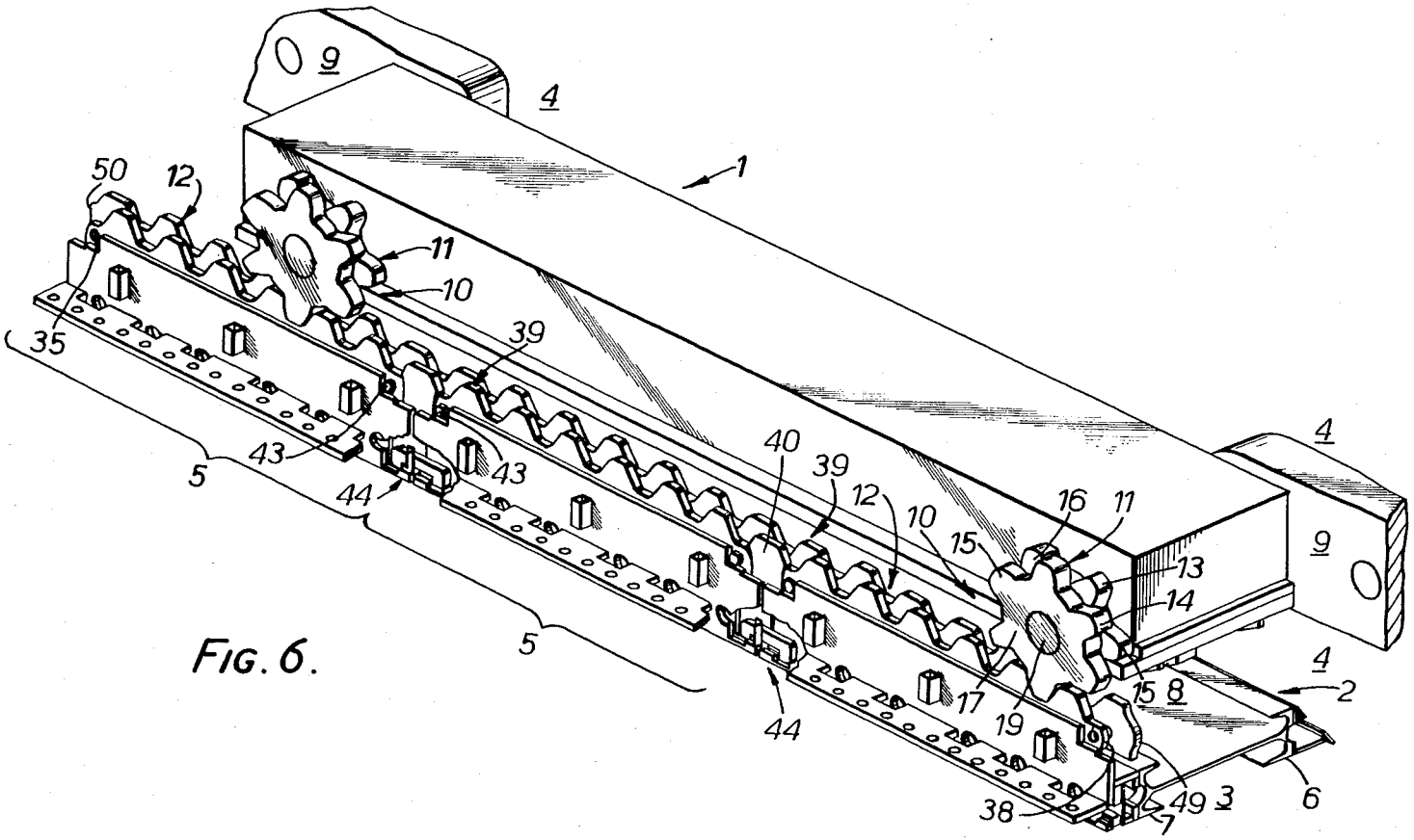
FIG. 6 is a view of a third embodiment of haulage system, mining machine and rack in accordance with the invention.

The embodiment of FIG. 6 illustrates a doubleended machine 1 with a ranging arm 9 at each end and with two haulage sprockets 12, one located towards each end of the machine 1.

Figure 7:
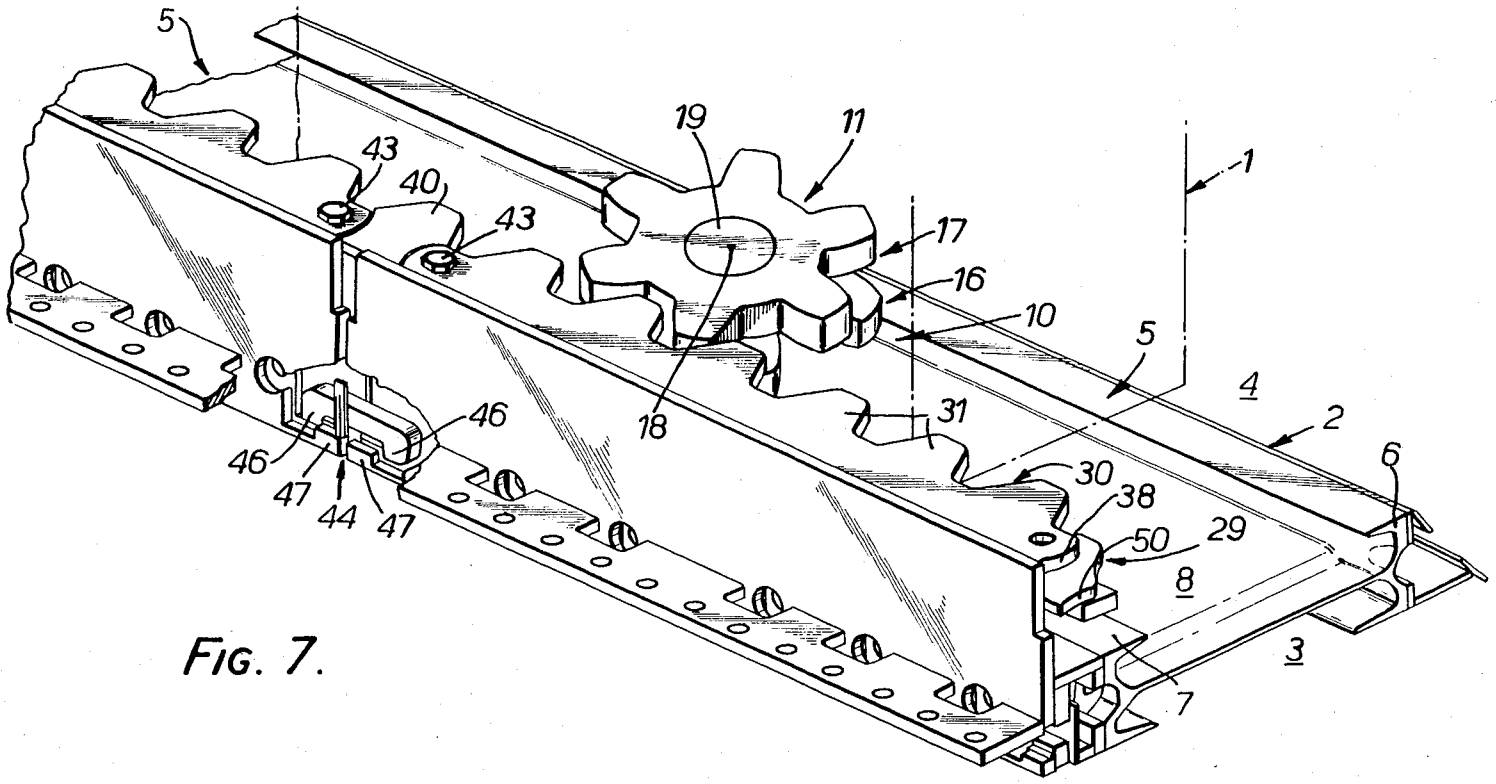
FIG. 7 is a view of a fourth embodiment of haulage system, mining machine and rack in accordance with the present invention.

The embodiment of FIG. 7, illustrates the machine 1 with a haulage sprocket 12 rotatable about a vertical axis.

I claim:

1. A haulage system for a mining machine, comprising at least one mining machine mounted on and/or guided by an armoured, scraper chain conveyor and reciprocable with respect to said conveyor, said conveyor extending along a mineral face and comprising a plurality of individual pans secured together end-to-end, a face side sidewall and a goaf side sidewall incorporated in each of said pans, a deck plate interconnecting said sidewalls of each said pan, one of said sidewalls being provided with a rack having two rows of laterally spaced rack teeth of identical pitch, said rack teeth of one said row being staggered with respect to said rack teeth of the other of said rows, an articulated joint securing together adjacent rack ends of adjacent pans, while teeth of one of said rows terminate short of said teeth of the other row to create a space between adjacent ends of adjacent shortened rack rows of adjacent pans, and a bridging tooth located in said created space and forming part of said articulated joint, said bridging tooth being provided with elongated mounting holes through which said bridging tooth is connected to said toothed plates to provide for tooth space compensation, and said machine further comprising at least one power driven haulage sprocket having two sets of peripherally arranged teeth of identical pitch, said sets being laterally spaced from one another and one of said sets being angularly staggered with respect to the other of said sets such that one of said sets is engageable with each of said rows of teeth of said rack.

2. A haulage system as set forth in claim 1, in which the rack is provided on the face side sidewall of the conveyor.

3. A haulage system as set forth in claim 1, in which the rack is provided on the goaf side sidewall of the conveyor.

4. A haulage system as set forth in claim 1, in which at least one haulage sprocket is formed from two individual and identical pinions secured coaxially together.

5. A haulage system as set forth in claim 1, providing a continuous surface extending in the direction of the rows of teeth whereby, in use, a projection of a trapping show mounted on, and carried by, a mining machine engages said continuous surface.

6. A haulage system as set forth in claim 1, in which one row of rack teeth terminates in a convex surface while the other row of rack teeth terminates at one end in a convex surface and at the other end in a complimentary concave surface.

7. A haulage system as set forth in claim 1, provided with rack teeth by flame cutting from plate.

8. A haulage system as set forth in claim 1, in which said system further comprises an inner, toothed plate carrying one row of teeth spaced from an outer, toothed plate carrying the other row of teeth by a spacer beam, both plates being joined to the spacer beam.

9. A haulage system as set forth in claim 8, in which one toothed plate has a lower edge projecting below that of the other toothed plate so as to enter a recess in a trapping shoe of a mining machine.

10. A haulage system as set forth in claim 1, in which the shortened rows terminate in convex ends and the bridging tooth is provided with complementary concave recesses.

11. A haulage system as set forth in claim 1, in which lower joints are also provided between adjacent racks, incorporating an inverted "U"-shaped connector, the downwardly directed ends of which engage behind abutment blocks.

* * * * *